United States Patent [19]

Schott

[11] Patent Number: 4,478,557

[45] Date of Patent: Oct. 23, 1984

[54] HYDRAULIC POWER TRANSDUCER

[75] Inventor: Marcel Schott, Fontenay Le Fleury, France

[73] Assignee: Messier-Hispano-Bugatti(s.a.), Montrouge, France

[21] Appl. No.: 470,669

[22] Filed: Feb. 28, 1983

[30] Foreign Application Priority Data

Mar. 5, 1982 [FR] France ..... 82 03670

[51] Int. Cl.[3] ..... F04B 35/00

[52] U.S. Cl. ..... 417/271; 91/499

[58] Field of Search ..... 417/271; 91/499, 504–507

[56] References Cited

U.S. PATENT DOCUMENTS

| | | | |
|---|---|---|---|
| 2,622,567 | 12/1952 | Myard | 91/499 |
| 2,850,986 | 9/1958 | Grad | 91/506 |
| 3,602,105 | 8/1971 | Slusher | 91/505 |
| 3,627,451 | 12/1971 | Kouns | 417/271 |

FOREIGN PATENT DOCUMENTS

| | | | |
|---|---|---|---|
| 1062037 | 4/1954 | France | 91/504 |
| 154156 | 2/1922 | United Kingdom | 91/507 |
| 1598311 | 9/1981 | United Kingdom | 91/499 |

*Primary Examiner*—William L. Freeh

[57] ABSTRACT

A two-way transducer for transfering power between two hydraulic circuits, e.g. to ensure uninterrupted hydraulic power in all the hydraulic circuits of a twin engined aircraft, even when one engine has failed. A body (1) has an elongate cavity (4) housing two barrels (14, 15) of cylinders (26) with pistons (28) slidably mounted therein. A common drive shaft (17) enables each barrel to drive the other. A wedge (16) located between the barrels provides two oblique surfaces (18, 19) for the piston heads to slide over. Sealing means (38, 39, 43, 44) to prevent fluid leaking from one circuit to the other. In operation one barrel operates as a swash-plate type of motor driving the other barrel which then acts as a pump.

5 Claims, 1 Drawing Figure

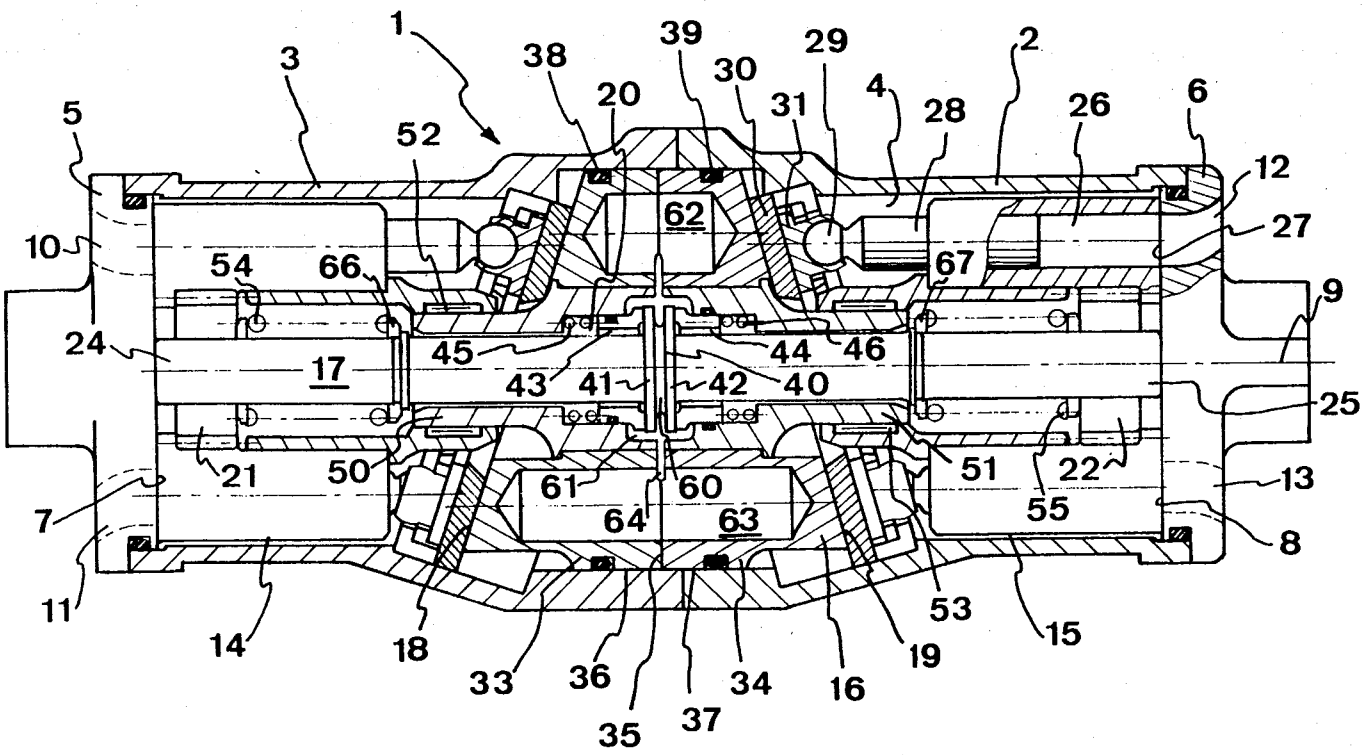
1
2
3
4
5
6
7
8
9
10
11
12
13
14
15
16
17
18
19
20
21
22
24
25
26
27
28
29
30
31
33
34
35
36
37
38
39
40
41
42
43
44
45
46
50
51
52
53
54
55
60
61
62
63
64
66
67

HYDRAULIC POWER TRANSDUCER

The present invention relates to hydraulic power transducers, sometimes referred to by persons skilled in the art as hydraulic power transfer sets. Such transfer sets generally comprise a motor coupled to a positive displacement pump.

BACKGROUND OF THE INVENTION

The combination of a motor with a positive displacement pump makes it possible, particularly in twin engined aircraft, to make do with only one hydraulic pump per engine for generating said hydraulic power, said generator means generally being driven by each engine or jet of the aircraft. In such a case, it is essential that one of the engines breaking down should not prevent the undercarriage from being retracted, for instance. Undercarriages are controlled by pressurised fluid which, ultimately, represents a source of power that enables the undercarriage to be retracted, eg. by means of jacks.

To avoid such a handicap, aircraft manufacturers provide their products with a special system constituted by a hydraulic power transfer set.

Thus, the hydraulic power generated by the working pump is applied to a single transfer set motor wihich drives the pump that is coupled thereto.

Said pump is connected in the fluid circuit for providing the flow necessary for retracting the undercarriage and, of course, for all the other servo controls to be found in such aircraft.

Further, this arrangement of a hydraulic power transfer set is advantageous in that it saves equipment mass by simplifying the accessory connection means, in particular by avoiding the need for a special power take off for a spare pump and also it requires only one pump instead of two half rated pumps.

This is thus a clear advantage for having such a power transducer.

Generally speaking, power sets are already known. They are built on the basis of a pair of positive displacement pumps having barrel piston chambers or barrels of cylinders, each barrel being rotated about an axis, and with the axes being coupled to each other, usually via gear means.

Clearly such a structure operates correctly. However, it still suffers from drawbacks due to the fact that its structure is not compact, and its mass still makes an important contribution to the total aircraft load.

Preferred embodiments of the present invention provide improved hydraulic power transfer sets of compact and hence lighter structure and which are also easier to manufacture.

SUMMARY OF THE INVENTION

More particularly, the present invention provides a hydraulic power transducer comprising: a body having an elongate oblong cavity whose two ends are delimited by two plane surfaces which are parallel to each other and which are situated about the same axis, said two surfaces constituting first and second slide faces, each having inlet and outlet openings therethrough; first and second barrels of cylinders disposed inside said cavity, each being mounted to rotate about said axis and each being in sliding contact with a respective one of said slide faces; a shaft disposed substantially along said axis and coupling said barrels of cylinders to rotate together; each barrel comprising a plurality of hollow cylinders, each cylinder having an opening in the face of its barrel which slides over the corresponding slide face, said openings being so disposed that they pass over said inlet and outlet openings during the course of barrel rotation, and each cylinder having a corresponding piston mounted therein to slide in sealed manner, the set of said pistons being connected to a shoe which is slidably mounted on a reference surface which is inclined relative to said axis in such a manner that, when said barrels of cylinders rotate, firstly the pistons are moved away from the openings in the cylinders in which they slide when said openings pass over an inlet opening, and secondly the pistons are moved towards the openings in the cylinders in which they slide when said openings pass over an outlet opening; a wedge disposed between said two barrels, with two faces of the wedge constituting bearing surfaces for said shoes, said wedge having an axial bore and being disposed in said cavity in such a manner that it surrounds said shaft; and sealing means co-operating both with said shaft and with said wedge.

BRIEF DESCRIPTION OF THE DRAWING

Other characteristics and advantages of the present invention appear from the following description given by way of non-limiting illustrative example with reference to the accompanying drawing, in which:

The sole FIGURE is a section through an embodiment of a hydraulic power transducer in accordance with the invention.

MORE DETAILED DESCRIPTION

The sole FIGURE is a section though an embodiment of a hydraulic power transfer set or transducer.

The set comprises a body 1, eg. comprising two half-shells 2 and 3, defining an oblong shaped interior cavity 4 which is substantially cylindrical. The two ends 5 and 6 of the body 1 define highly plane surfaces 7 and 8 which face each other and which are perpendicular to a common axis 9. The surfaces 7 and 8 define two slide faces each of which has a pair of openings 10 and 11, or 12 and 13. The openings are connected to pipework, and one opening of each pair constitutes a fluid inlet opening while the other constitutes a fluid outlet opening, as is explained below.

Four main components are disposed inside the cavity 4:

- a first barrel of cylinders 14 whose ends are pressed against the slide face 7;
- a second barrel of cylinders 15 whose ends are pressed against the slide face 8;
- a wedge 16 situated between the two barrels 14 and 15, said wedge having a transverse bore 20 and being delimited at its ends by two sloping surfaces 18 and 19 which are at an angle relative to the axis 9; and
- a shaft 17 aligned along said axis 9, said shaft running along the cavity 4 from end to end to couple the barrels 14 and 15 eg. by means of gears 21 and 22 connecting the ends 24 and 25 of the shaft 17 which is made out of a single piece.

Advantageously the two barrels 14 and 15 are identical, each comprising, for example, a cylindrical portion in which cylinders 26 are uniformly distributed. One of said cylinders 26 is shown partially cut away to show a cylinder opening 27 against the corresponding one of the slide faces 7 and 8.

Pistons 28 are mounted to slide in a sealed manner in the cylinders 26.

Each piston 28 has a head 29 mounted on a support plate 30 by means of a shoe 31.

The support plates for the barrels are pressed against corresponding ones of the two sloping surfaces 18 and 19 of the wedge 16, and the support plates could optionally be constituted as integral parts of the wedge 16.

Each of the barrels is coupled to the shaft 17 at respective one of its ends 24 and 25 by means of gears 21 and 22.

As mentioned above, the shaft coupling the two barrels is made out of a single piece, which simplifies manufacture and improves the coupling between the barrels such that when one of the barrels is rotated, as explained below, the same rotary movement is applied to the other barrel by means of the shaft 17. However, it must be understood that the gears could have different gear ratios if it is necessary for one of the barrels to rotate faster than the other.

As described above, the two barrels are separated by the wedge 16 which is advantageously made from two parts 33 and 34 which are pressed together along a plane 35. The outside surface of the wedge 16 fits closely to the inside surface of the cavity 4 in the body 1.

The wedge is mounted as a seal. The sealing is obtained firstly by means of sealing rings 38 and 39 for avoiding peripheral transfer of fluid, which might otherwise take place between one of the ends of the cavity 4 containing one of the barrels to the other end containing the other barrel, and secondly by means of rotating seals to avoid fluid being transferred along the space between the shaft 17 and the surface of the bore 20.

The rotating seal comprises a collar 40 which is integral with the shaft 17 with two lateral faces 41 and 42 sliding against two sealing members 43 and 44. The sealing members are pressed against the surfaces 41 and 42 on the collar 40 by means of respective springs 45 and 46 which bear against shoulders made in the wedge 16.

Advantageously, the wedge 16 has two bearing support members 50 and 51 projecting from and are made fast to the parts 33 and 34. The bearing members constitute sleeves surrounding the shaft 17 and they pass through respective ones of the barrel plates. They provide axial guiding and retaining means for the two barrels by means of respective bearings 52 and 53, eg. pin bearings.

Further, the collar 40 has a peripheral groove 60 opening out into a space 61 which communicates with voids 62 and 63 in the wedge 16 in such a manner that if ever there is a leak around the rotating seals, the fluid will accumulate in the voids after passing along passages 64. Of course, the voids 62 and 63 also serve to reduce the weight of the material used and thereby contribute to providing a light weight transfer unit.

Finally, the above mentioned gears 21 and 22 allow the barrels 14 and 15 to move axially in known manner, so that the barrels can be kept pressed firmly against their sliding faces 7 and 8 by means of two springs 54 and 55 which bear against the projecting ends 66 and 67.

This technique based on barrels of cylinders is well understood, and its operation does not need explaining to the person skilled in the art.

The embodiment illustrated is advantageous essentially because of its unitary and one-piece construction which contributes to obtaining the results mentioned above in the introduction, in particular concerning the ease of fabrication and the reduction in weight of the material on board an aircraft.

The device operates as follows:

First it should be observed that although the inclined planes 18 and 19 are at the same angle to the axis 19, they could be inclined at angles differing by a few degrees, if necessary, to enable the barrels to have differing cylinder capacities.

such a difference may be necessary to ensure a greater discharge pressure and to avoid interference between the two pumps.

This said, when it is desired to operate the transfer set, fluid should be applied under pressure to the fluid inlet to one of its two barrels, which will then operate in convetional manner as a motor and drive the other barrel which then operates as a pump thereby sucking in and then discharging fluid present at its own fluid inlet. The shaft 17 provides ideal coupling between the two barrels while one is acting as a motor and the other as a pump.

However, because of this configuration, the functions can be swapped over, especially in the event of a break down as mentioned above. In that case the barrel which was pumping can start acting as a motor, once fluid under pressure is applied thereto, and thus drive the other barrel which begins operating as a pump.

This both-way operation is known and is identical to that obtained in the prior art since the present transfer set uses the same principle of operation internally. However, it undoubtedly provides structural advantages over the prior art versions.

I claim:

1. A hydraulic power transducer comprising: a body having two ends delimiting an elongate oblong cavity, said body ends delimiting two plane surfaces which are parallel to each other and which are situated about the same axis, said two surfaces constituting first and second slide faces, each body end having inlet and outlet openings therethrough; first and second barrels of cylinders disposed inside said cavity, each barrel being mounted to rotate about said axis and each barrel being in sliding contact with a respective one of said slide faces; a shaft disposed substantially along said axis coupling said barrels of cylinders to rotate said barrels together; each barrel comprising a plurality of hollow cylinders, each cylinder having an opening in one face of its barrel which slides over the corresponding slide face, said openings being so disposed that they pass over said inlet and outlet openings during the course of barrel rotation, and each cylinder having a corresponding piston mounted therein to slide in sealed manner, said pistons forming a set, said set of said pistons being connected to a shoe, said shoe being slidably mounted on a reference surface which is inclined relative to said axis such that, when said barrels of cylinders rotate, firstly the pistons are moved away from the openings in the cylinders in which they slide when said openings pass over an inlet opening, and secondly the pistons are moved towards the openings in the cylinders in which they slide when said openings pass over an outlet opening; a wedge disposed between said two barrels having two opposed faces constituting bearing surfaces for said shoes, said wedge having an axial bore and being disposed in said cavity such that it surrounds said shaft; and sealing means for both said shaft and said wedge; and wherein said sealing means comprises a collar made fast to said shaft, sealing members for pressing against the side faces of said collar, and means for applying pressure to said sealing members to keep them pressed against the collar.

2. A transducer according to claim 1, wherein the collar includes a peripheral groove.

3. A transducer according to claim 2, wherein said wedge includes at least one void, and means providing communication between said void and said groove.

4. A transducer according to claim 1, wherein said wedge is constituted by two members pressed against each other in a plane.

5. A transducer according to claim 4, wherein said outside surfaces of said parts respectively area a close fit with the inside cavity surface of said body.

* * * * *